United States Patent [19]

Corrans et al.

[11] Patent Number: 4,729,827

[45] Date of Patent: Mar. 8, 1988

[54] MAGNETIC SEPARATOR

[75] Inventors: Ian J. Corrans; Jan Svoboda, both of Randburg, South Africa

[73] Assignee: Council for Mineral Technology, Randburg, South Africa

[21] Appl. No.: 871,147

[22] Filed: Jun. 3, 1986

Related U.S. Application Data

[63] Continuation of Ser. No. 608,593, May 9, 1984, abandoned.

[30] Foreign Application Priority Data

May 10, 1983 [ZA] South Africa ..... 83/3323

[51] Int. Cl.[4] ..... B03C 1/02

[52] U.S. Cl. ..... 209/223.1; 209/225; 209/232

[58] Field of Search ..... 209/636, 213–215, 209/218, 223 R, 225, 231, 232; 198/690

[56] References Cited

U.S. PATENT DOCUMENTS

| | | | |
|---|---|---|---|
| 3,006,472 | 10/1961 | Clute | 209/214 |
| 3,902,994 | 9/1975 | Maxwell et al. | 209/218 X |
| 3,935,095 | 1/1976 | Susse et al. | 209/232 X |
| 4,066,537 | 1/1978 | Bernfeld | 209/232 X |
| 4,129,498 | 12/1978 | Clark et al. | 209/232 X |
| 4,246,097 | 1/1981 | Pouillon | 209/232 X |
| 4,260,477 | 4/1981 | Corrans | 209/223 X |

FOREIGN PATENT DOCUMENTS

| | | | |
|---|---|---|---|
| 2130560 | 2/1972 | Fed. Rep. of Germany | 209/225 |
| 2532493 | 2/1977 | Fed. Rep. of Germany | 209/232 |
| 1348915 | 3/1974 | United Kingdom . | |
| 1371623 | 10/1974 | United Kingdom . | |
| 1435861 | 5/1976 | United Kingdom . | |
| 1590034 | 5/1981 | United Kingdom . | |

*Primary Examiner*—Robert B. Reeves
*Assistant Examiner*—Edward M. Wacyra
*Attorney, Agent, or Firm*—Cushman, Darby & Cushman

[57] ABSTRACT

The invention provides a magnetic separator for the separation of a fluid mixture into a more magnetic portion and a less magnetic portion wherein the magnetic field generator comprise a pair of solinoid coils located opposite each other and between which a conveyor assembly carrying a matrix of magnetic elements and the fluid material to be treated passes during use of the magnetic separator.

8 Claims, 7 Drawing Figures

MAGNETIC SEPARATOR

This is a continuation of application Ser. No. 608,593 filed May 9, 1984 which was abandoned upon the filing hereof.

FIELD OF THE INVENTION

This invention relates to a magnetic separator and, more particularly, to a separator employing a matrix of magnetic elements which are, at times temporarily magnetised by being located in a magnetic field and through which a fluid mixture containing materials of differing magnetic properties can be passed in order to separate the more magnetic particles from the less magnetic particles.

BACKGROUND TO THE INVENTION

Magnetic separators arranged to effect a separation of more magnetic particles from less magnetic particles are well known. In an early form, and one which is still employed for the separation of highly magnetic particles, free falling particles are passed through a magnetic field. A separation is created as a result of the lateral movement of the more magnetic particles relative to the less magnetic particles.

In order to treat more weakly magnetic parricles, and extract same, it has been necessary to employ a matrix of magnetic elements, as mentioned above, in order that a stronger magnetic field gradient be created in order to remove, from a through-flow of a fluid mixture, the weakly magnetic particles whilst allowing the substantially non-magnetic particles to pass through the matrix.

Numerous different forms of matrix arrangements have been employed and, in general, the magnetic field is created by the spaced poles of a magnet between which a feed path for the matrix is defined. Such feed path can be defined by an annular container or carousel, arranged either horizontally or vertically, and adapted to rotate with a zone of its circumferential length located between the poles of the magnet.

The presence of the magnetic poles, which must be magnetised by a coil associated therewith, limits the intensity of the magnetic field which can be applied to the matrix of magnetic elements as a result of the attainment of magnetic saturation of the pole forming material.

A further problem which must be mentioned is that slurries, the particles of which are to be separated, often include wood fibres, tramp iron or other contaminants which reduce the effectivenes. If the magnetic separation over a period of time. Indeed, it is advantageous, to regularly wash and clean the matrix of magnetic elements.

As an alternative to the pair of magnetic poles, between which the matrix is passed, there has been proposed a single solenoid coil of the usual annular shape and into which an arcuate portion of a carousel or container extends by reason of its convexity. The inner diameter of the solenoid must, in consequence of this physical arrangement, be substantial relative to the diameter of the carousel or container thus limiting its effectiveness. It is to be mentioned that the matrix could assume any suitable form such as a plurality of separate elements, freely movable relative to each other in the unmagnetised state. The matrix could, however, also be composed of a metal mat or pad or a series of woven metal mesh members.

It is the object of this invention to provide an improved magnetic separator wherein the intensity of the magnetic yield is improved and, in addition, the means for conveying the matrix of magnetic elements and the nature of the magnetic elements itself may be of an improved nature which facilitates the cleaning of the matrix of the magnetic elements.

In this specification the term two coils is intended to include saddle coils and the like, and the term magnetic is intended to include matter which is capable of acquiring properties of, or being attracted by, a magnet.

SUMMARY OF THE INVENTION

In accordance with one aspect of this invention there is provided a magnetic separator comprising a conveyor assembly arranged for conveying a matrix of magnetic elements through at least one magnetic field set up by magnetic field generating means associated with the separator, a feed inlet for supplying feed material to be subjected to separation to the region of the conveyor present at any time in said magnetic field, means for conducting saio feed material away from said matrix in the region of the magnetic field, and means for removing magnetic particles retained by the matrix at a region outside of the magnet:c field, the apparatus being characterised in that the magnetic field generating means comprises a pair of solenoid coils located opposite each other with the conveyor passing therebetween and being adapted to co-operate to set up said magnetic field, upon activation thereof.

Further features of the invention provide for the conveyor assembly to assume the form of an annular carousel or container rotatable either in the operatively vertical or horizontal planes or, more preferably, for the conveyor assembly to be an endless flexible belt assembly having a substantially straight operative path; for the solenoid coils of a pair to be joined to each other by suitable cladding so that each pair of solenoid coils is embodied in a single unit; and for the cladding to be provided with suitable openings for permitting the conveyor assembly to pass through, for introducing fluid, and for removing feed material from the conveyor assembly.

Still further features of the invention provide for the matrix of magnetic elements to be composed of a plurality of separate elements optionally movable relative to each other; and for the magnetic separator to include means for washing the matrix of magnetic elements in situ or alternatively to include means for discharging some or all of the matrix elements into a washing station with additional means being provided for returning washed elements to the conveyor assembly.

It is known to use substantially spherical magnetic elements to constitute the matrix, and conveniently the conveyor assembly according to this invention may be sub-divided into partitions for containing such a matrix.

A retaining screen can, if required, be provided to retain the matrix elements in position n the partitions of the conveyor assembly during the entire cycle. In such an instance, the matrix elements will only be washed or cleaned thoroughly at suitably chosen points in time which will involve the removal of the elements from the partitions.

Preferably, the matrix elements according to this invention each comprise a leaf which is substantially rectangular in shape and which is defined by a magnetic wire mesh, whereof one edge is mounted transversely to the conveyor assembly at suitable distances from adjacent leaf elements over at least a substantial part of the length of the conveyor assembly. The conveyor assembly may be provided with means for insuring that the surface of the leaf elements remain substantially perpendicular to the surface of the conveyor, for example, by means of a frame optionally separable from the leaf element. Tne endless conveyor, where same is employed, can be fed, on its return pass, through suitable washing stations in order to clean same and remove scale.

BRIEF DESCRIPTION OF THE DRAWINGS

In order that the invention may be more fully understood one embodiment thereof will now be described with reference to the accompanying drawings in which.

DETAILED DESCRIPTION WITH REFERENCE TO THE DRAWINGS

Figure 1:
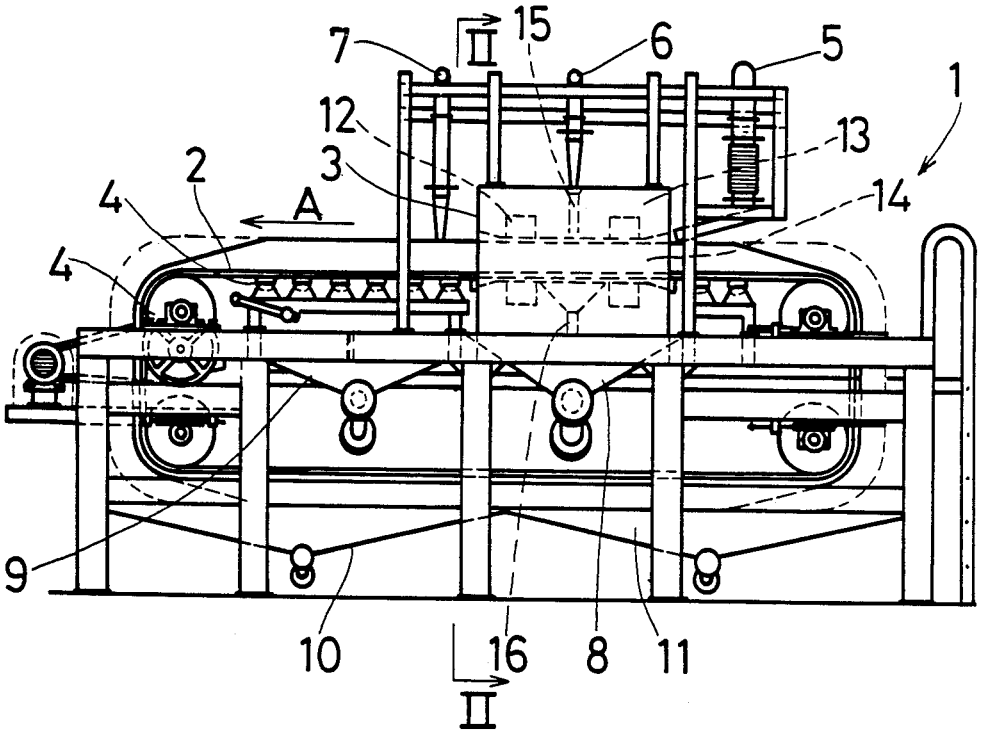
FIG. 1 is a schematic side elevation of a magnetic separator according to this invention.
Figure 2:
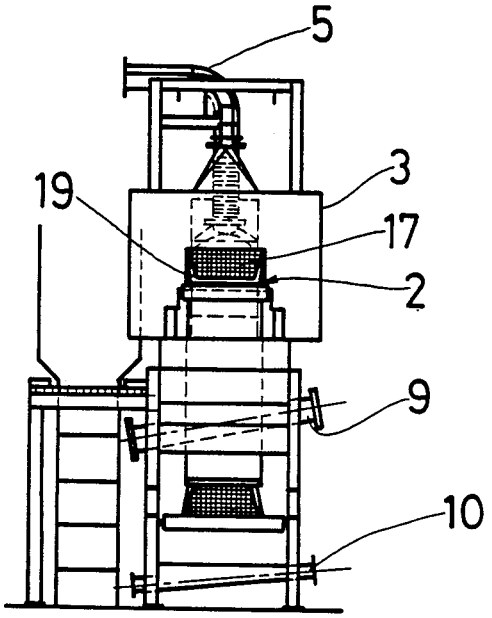
FIG. 2 is a cross-sectional view through the embodiment illustrated in FIG. 1 taken along the line "II—II"

As illustrated in FIG. 1 and FIG. 2, the magnetic separator generally indicated by numeral 1 includes a conveyor assembly having an endless flexible belt 2 movable in the direction indicated by arrow "A" and having a straight operatively horizontal run which passes through magnetic field generating means 3 associated with the separator 1. Guide pulleys 4 are provided in the path of the belt 2 to form the required endless configuration.

The magnetic separator 1 further comprises a feed inlet 5 adapted to discharge feed material onto the conveyor belt 2 upon entering the magnetic field generating means 3; a first water inlet 6 adapted for flushing the conveyor belt 2 inside the magnetic field generating means 3; a second water inlet 7 adapted for flushing the conveyor belt 2 after it exits the magnetic field generating means 3; a first funnel-shaped feed outlet 8 for receiving and discharging any substantially non-magnetic feed material which is flushed away from the conveyor belt 2 in the area of the magnetic field by means of the water coming through the first water inlet 6; and a second funnel-shaped fluid outlet 9 for receiving and discharging any magnetic feed material which is flushed away from the conveyor belt 2 after exiting the magnetic field generating means 3.

The return path of the conveyor passes through washing and rinsing stations 10 and 11. Rinsing can be effected by water or water plus additions (eg. acids and alkalis) to assist cleaning. Mechanical cleaning may also be used.

Figure 3:
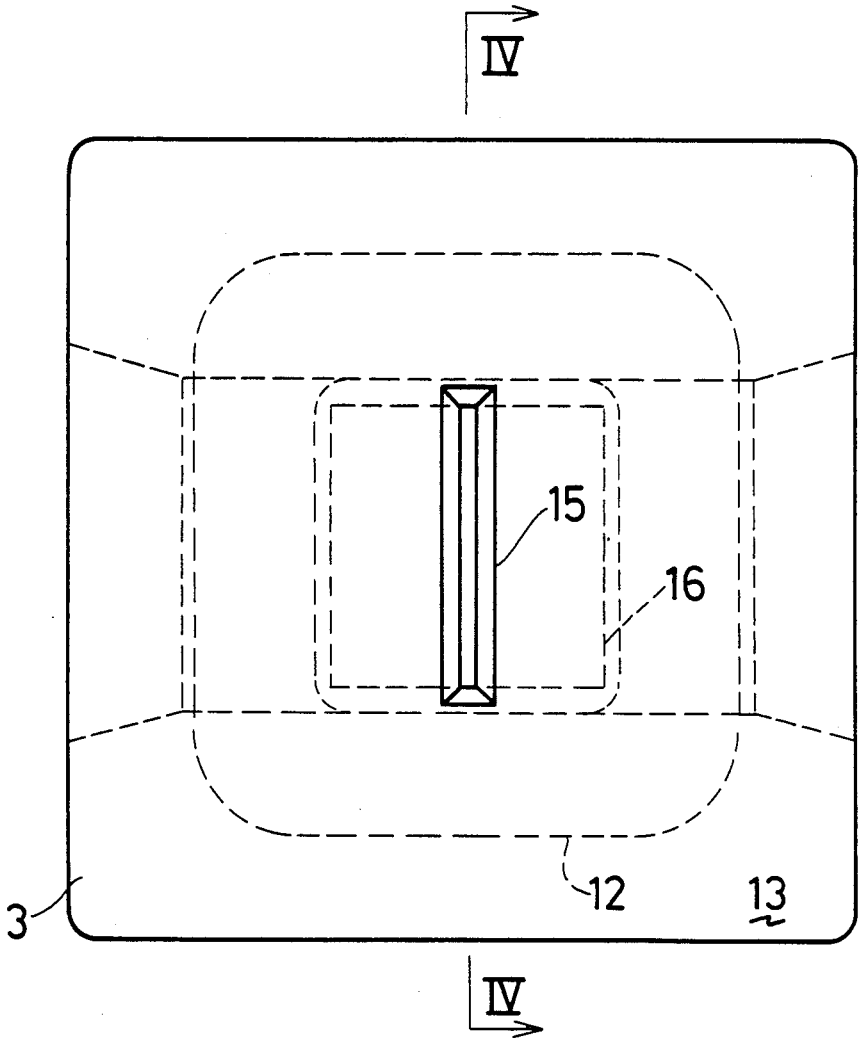
FIG. 3 is a plan view of the magnetic field generating means of the magnetic separator of FIG. 1.

The magnetic field generating means 3 are illustrated in cross-section in FIG. 1, along the line "I—I" of the plan view of FIG. 3 (and shown in dotted lines in FIG. 1) and comprise a pair of iron-clad solenoid coils 12 arranged co-axially with each other and held in their operative position relative to each other by a cladding 13. The cladding 13 is provided with a suitable opening 14 for allowing the conveyor belt 2 to pass between the solenoid coils 12.

A further slit-like opening 15, more clearly illustrated in FIG. 3, is provided in the cladding 13, and runs through the center of the operatively uppermost coil transverse to the belt opening 14. The slit-like opening 15 is adapted to receive and distribute any rinse water coming from the first water inlet 6 located above the magnetic field generating mean 3.

The cladding 13 includes still another opening 16 which is conical in shape and of square cross-section. This conical opening 16 runs through the centre of the operatively lowermost coil, co-axially with the slit-like opening 15 and in use receives substantially non-magnetic material for discharge into the first feed outlet 8.

Figure 4:
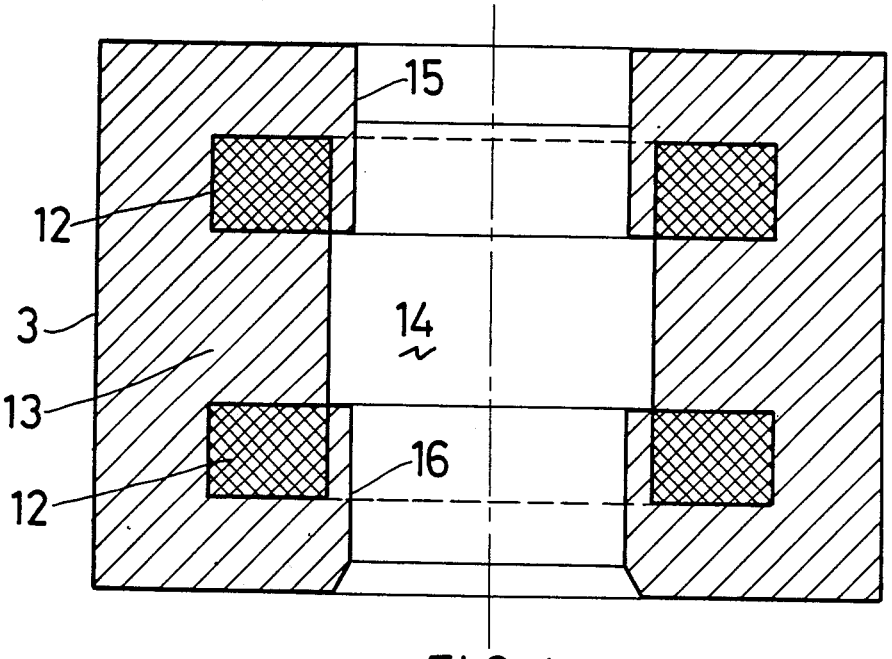
FIG. 4 is a cross-sectional view of the magnetic field generating means of FIG. 3 taken along line "IV—IV"

FIGS. 3 and 4 illustrate the configuration of the magnetic field generating means 3 in greater detail.

Figure 5:
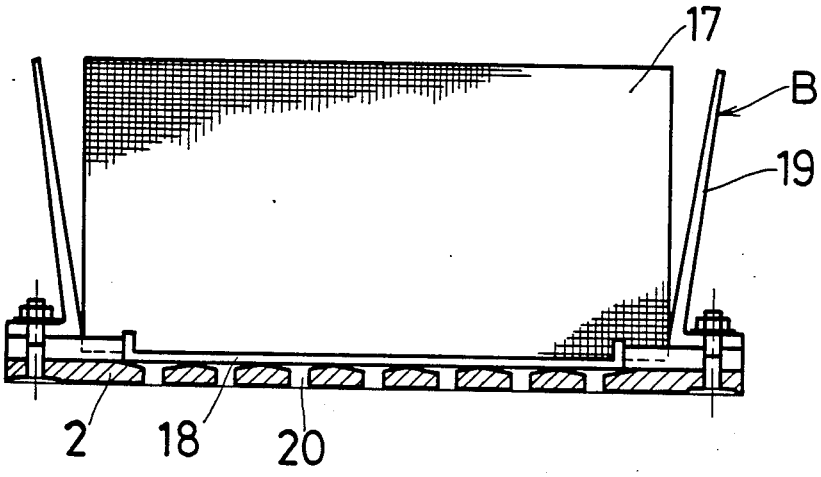
FIG. 5 is a cross-sectional view of the conveyor assembly of the embodiment illusrrated in FIG. 1, including the magnetic wire mesh matrix element conveyed thereon.

Referring particularly to FIG. 5, the conveyor belt 2 of the magnetic separator 1 is shown in association with a rectangular wire mesh element 17 whereof the operatively lowermost edge is attached to the belt 2 by means 18. The belt assembly further includes a pair of frame elements 19 for laterally supporting the wire mesh element 17 in an upright position relative to the surface of the conveyor belt 2. The wire mesh element 17 is thus bound on three sides by the conveyor belt assembly with the operatively uppermost edge left bare.

The frame elements 19 are substantially "L-shaped", with the legs of the "L" defining an acute angle therebetween. Thus, in order for the frame element 19 to rest against the associated lateral edge of the wire mesh element 17, and for the legs of the "L" to define a right angle, a pressure must be exerted onto the frame element 19 in the direction indicated by arrow "B". Conveniently, the required pressure may be provided by guides or rollers (not snown) appropriately located inside the opening 14 of the cladding 13 ro the magnetic field generating means 3.

During use of the magnetic separator 1, a slurry of feed material containing a mixture of more or less magnetic particles is fed to the matrix supporting conveyor belt 2 upon entering the magnetic field generating means 3 so that the particles can be separated into a substantially non-magnetic fraction and a magnetic fraction.

Inside the magnetic field generating means 3, the wire mesh elements 17 constituting the matrix are magnetized and the more magnetic particles adhere thereto. The less magnetic particles fall freely by gravity through holes 20 provided in the conveyor belt 2, and are collected in the cone shaped opening 16 of the magnetic field generating means 3 for eventual discharge into the associated feed outlet 8. Rinse water from the first water inlet 6 operatively located above the magnetic field generating means may be used for regulating the degree of separation of the less magnetic particles from the more magnetic particles.

As the loaded matrix exits the magnetic field generating means 3, it is demagnetized and the more magnetic particles may be washed at least to a substantial extent, from the matrix elements. The more magnetic particles are discharged into the second feed outlet 9 and are washed with water coming from the second water inlet 7 which is operatively located above the second feed outlet 9.

In order to assist the removal of debris from the wire mesh elements 17, they are released from the frame elements 19 after exiting the magnetic field generating means 3 and the distance between the upper edges of adjacent elements 17 is allowed to flare, particularly in the areas where the direction of path of the conveyor belt 2 is changed by means of the guide pulleys 4.

Conveniently, rotary valves (not shown) may be used on the pulley shafts to feed compressed air, water, or other washing substances under pressure to blow through the fanned out matrix and effect the removal of tramp material.

The wash means can be of any type and can employ demagnetisors in order to remove and magnetic particles adhering to the matrix elements in view of any residual magnetism which they may retain.

The washing and rinsing stations 10 and 12 on the return path of the conveyor belt 2 further clean the belt 2, whereafter it proceeds to repeat the cycle.

Figure 7:
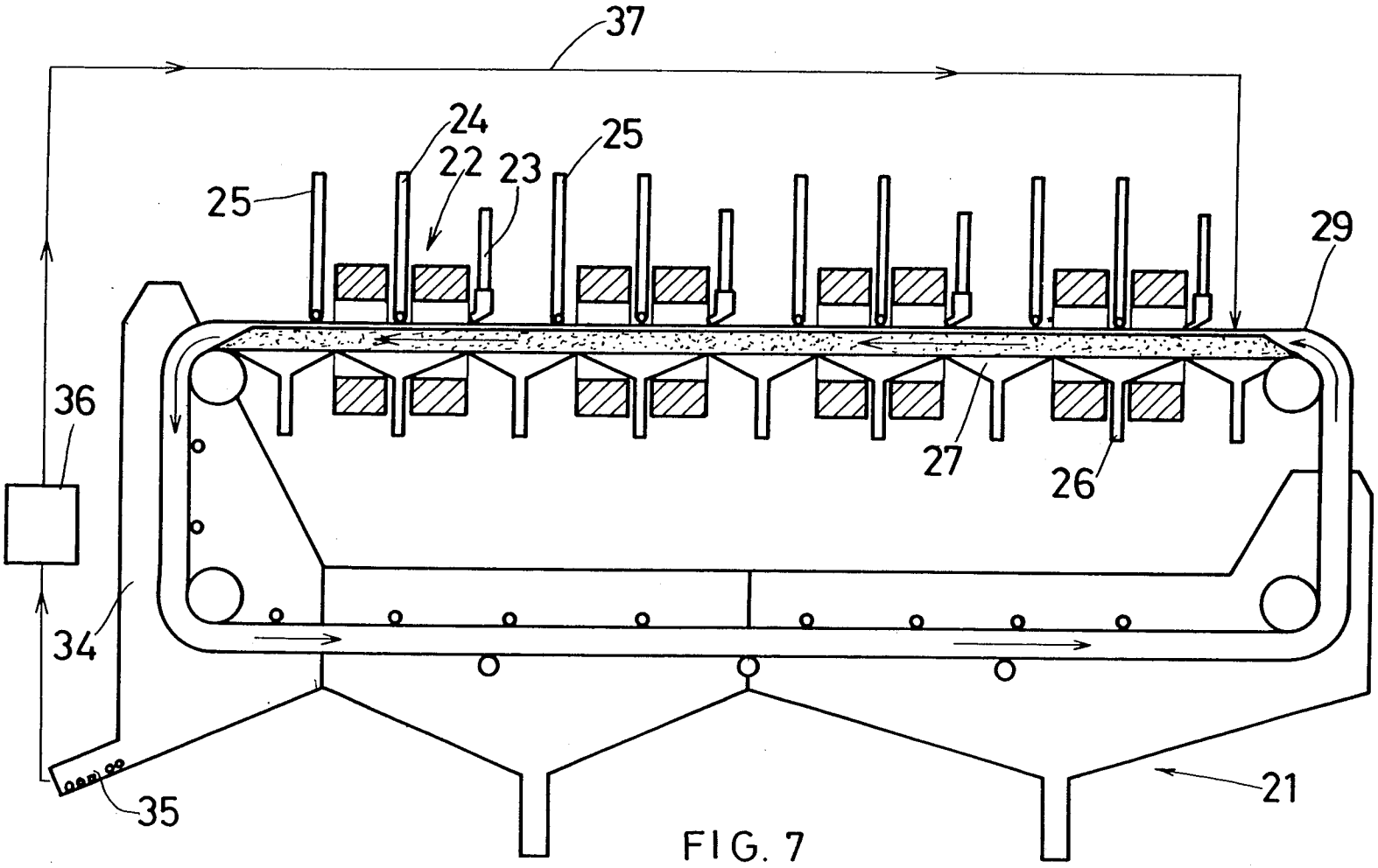
FIG. 7 is a schematic side elevation of an alternative embodiment of the magnetic separator according to this invention.

Numerous variations may be made to the abovedescribed embodiment of the invention without departing from the scope thereof. In particular as illustrated in FIG. 7, the magnetic separator 21 may comprise a plurality of magnetic field generating means 22 arranged in a straight horizontal line and spaced apart by a suitable distance.

In the embodiment illustrated, four independant stages of a magnetic separation system, each associated with appropriate feed 23 and water inlets 24 and 25 and feed outlets 26 and 27, are employed for each part of the conveyor.

It is quite obvious that two or more stages could be employed in series but, generally speaking, they will be employed in a parallel type of operation. This means that fresh feed will be fed to each of the feed inlet assemblies 23.

Figure 6:
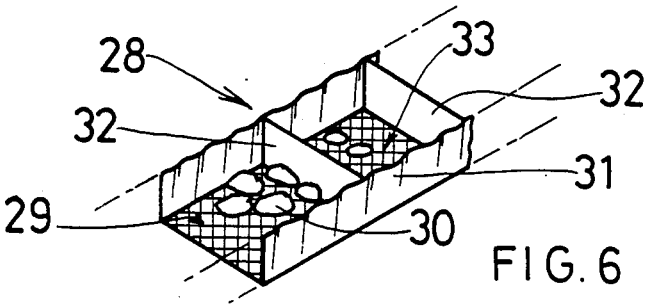
FIG. 6 illustrates schematically an alternative conveyor belt for use in the magnetic separator of FIG. 1.

An alternative conveyor belt 28 is illustrated in FIG. 6 and comprises a base 29 which is of a pervious nature so that a slurry, for example, can flow therethrough without appreciable interference. However, this pervious base 29 is to retain matrix elements which may be in any suitable form but, can conveniently, be in the form of metal balls 30.

The conveyor has side walls 31 which are suitably pleated so that the pleats increase in size up the side walls 31. The arrangement is such that the entire conveyor can pass around guide pulleys in the path thereof to form the required endless configuration. Partition walls 32 are provided between the opposite side walls to define compartments 33 in the conveyor for containing the matrix elements 30.

Such a belt 29 is employed in the embodiment of the magnetic separator 21 illustrated in FIG. 7. Here an arrangement generally indicated by numeral 34 is provided at the end of the operative pass of the conveyor so that matrix elements tumble from the conveyor and into a chute 35. From there they proceed to a washing station indicated by numeral 36 and are returned by a conveyor 37 to the conveyor assembly at a position ahead of the entry into the first magnetic field generating means.

It will be understood that, in use, the pleated or flared side walls of the conveyor enable it to pass around the path described without being deformed in any delererious manner.

Still more variations may be made to the abovedescribed embodiments of the invention without departing from the scope thereof. In particular the number and orientation of the washing stations can be varied as required. Instead of the solenoid coils being located in horizontal planes, they could be located in vertical planes. The belt described in the latter embodiment could be replaced by a metal mesh belt having retaining side walls of any suitable type. The conveyor assembly could alternatively be of an annular carousel type whether located in a vertical or horizontal plane. The number of magnetic field generating means could be only one or any other number that may be required.

It will be understood by those skilled in the art that the employment of solenoid coils in the abovedescribed configuration enables high magnetic field intensities to be employed and, indeed, field intensities which exceed those which are attainable employing poles of magnetic material. The simple physical arrangement of the coils and conveyor assembly enable the conveyor assembly to be introduced laterally in between the coils and, accordingly, a splice in the conveyor length is not necessary. Also the simple arrangement of the coils enable superconducting coils to be employed as they can easily be insulated as required and provided with the means for maintaining low temperatures associated with super conductivities.

Scale up of magnetic separators according to this invention is extremely simple and also, increase of the diameter of the solenoids results only in an increase in power consumed as a result of the increase in length and thus resistance of the wire.

It is to be understood that in the case of prior art types of magnetic separator which generate a magnetic field using iron yoke, it is impractical to generate field strengths above approximately 1,2 Tesla. Higher fields may only one generated at high power cost and reduced machine capacity. By using a solenoid coil design, fields in excess of 2 Tesla can be generated in an economic manner still maintaining high machine capacity. If still higher fields are desired, the solenoids could be made superconducting by use of cryogenic systems. With superconducting coils, field strengths in excess of 3 Tesla can be generated.

The invention therefore provides an extremely simple yet highly effective magnetic separator.

What we claim as new and desire to secure by Letters Patent is:

1. A magnetic separator comprising:

a conveyor assembly arranged for conveying a matrix of magnetic elements through at least one magnetic field set up by magnetic field generating means associated with said separator;

a feed inlet for supplying feed material to be subjected to separation in a first region of said conveyor assembly which is present at any time in said magnetic field, said first region of said conveyor assembly being at least roughly horizontal;

means for conducting said feed material away from said matrix in the region of the magnetic field; and means for removing magnetic particles retained by said matrix at a second region of said conveyor assembly which is outside of the magnetic field, the separator being characterized in that:

the magnetic field generating means comprises at least one pair of solenoid coils located opposite each other with the axes thereof being substantially upright and substantially at right angles to said first region of said conveyor assembly with one coil located above and the other one below said conveyor assembly and wherein the coils of a pair are joined to each other by cladding so that each pair of solenoid coils is embodied in a single unit having openings for permitting said conveyor assembly to pass therethrough between said coils, whereby the capacity of said separator can be increased by increasing the width of said conveyor assembly as respects said first region and commensurately increasing the corresponding width of said coils while maintaining the same vertical spacing therebetween to thereby maintain the same flux intensity in said first region without a substantial increase in power consumption.

2. A magnetic separator according to claim 1 wherein the cladding is provided with suitable additional openings for introducing fluid and for removing feed material from the conveyor assembly.

3. A magnetic separator according to claim 1 wherein the conveyor assembly assumes the form of an annular carousel or container rotatable either in the operatively vertical or horizontal planes.

4. A magnetic separator according to claim 1 wherein the conveyor assembly is an endless flexible belt assembly having a substantially straight operative path which lies in a horizontal plane.

5. A magnetic separator according to claim 1 wherein the matrix of magnetic elements is composed of a plurality of separate elements movable relative to each other.

6. A magnetic separator according to claim 5 which includes means for discharging some or all of the matrix elements into a washing station with additional means being provided for returning washed elements to the conveyor assembly.

7. A magnetic separator according to claim 1 wherein the matrix of magnetic elements comprises a pluraliry of separate elements whereof each element comprises a leaf which is substantially rectangular in shape and which is defined by a magnetic wire mesh whereof one edge is mounted transversely to the conveyor assembly at suitable distances from adjacent leaf elements over at least a substantial part of the length of the conveyor assembly.

8. A magnetic separator according to claim 7 which includes means for washing the matrix of magnetic elements in situ.

* * * * *